United States Patent [19]

Yonker et al.

[11] 4,418,756

[45] Dec. 6, 1983

[54] METHOD AND APPARATUS FOR PERFORMING OPERATIONS IN WELL TUBING

[75] Inventors: John H. Yonker, Carrollton; Henry P. Arendt, Dallas, both of Tex.

[73] Assignee: Otis Engineering Corporation, Dallas, Tex.

[21] Appl. No.: 299,931

[22] Filed: Sep. 8, 1981

[51] Int. Cl.[3] ..... E21B 23/08

[52] U.S. Cl. ..... 166/383; 166/70; 166/153

[58] Field of Search ..... 166/383, 153, 381, 379, 166/378, 156, 70, 322, 335, 362, 351, 367, 241; 15/106.06 R, 106 A

[56] References Cited

U.S. PATENT DOCUMENTS

| | | | |
|---|---|---|---|
| 3,587,740 | 6/1971 | Gerwick et al. | 166/241 X |
| 4,027,730 | 6/1977 | Sparlin | 166/156 |
| 4,039,027 | 8/1977 | Churchman et al. | 166/153 |
| 4,062,403 | 12/1977 | Sparlin | 166/156 |
| 4,078,810 | 3/1978 | Arendt | 166/153 X |
| 4,227,573 | 10/1980 | Pearce et al. | 166/153 |

*Primary Examiner*—Stephen J. Novosad
*Assistant Examiner*—Michael J. Starinsky
*Attorney, Agent, or Firm*—Vinson & Elkins

[57] ABSTRACT

A pumpdown system in which the pistons providing for movement of the train into and out of the well do not travel down into the tubing below the wellhead and are connected to tools through reach rods extending down into the tubing. The cathead effect resulting from working around the loop with pistons is minimized by guides which substantially center the pistons in the loop and in the preferred form by the use of straight sections of the loop.

13 Claims, 5 Drawing Figures

14
24
28
19
23
26
29
22
18
21
17
28

METHOD AND APPARATUS FOR PERFORMING OPERATIONS IN WELL TUBING

This invention relates to TFL completions and more particularly to landing and retrieving tools or performing other operations while pistons of a TFL train are in the entry loop attached to the wellhead.

One common method of landing and retrieving tools from a well, shifting sleeves, etc., employs the through flow line method (TFL) in which a pumpdown train made up of pistons and a tool is pumped through the tubing to land or retrieve equipment or perform operations in the well. To reverse circulate the train out of the well, it is necessary that a flow conduit in addition to the tubing be provided with fluid access to the tubing below the train. A common system employs parallel tubing connected adjacent the lower end of the tubing with an H-member. Reference is made to a catalog entitled *OTIS PUMPDOWN COMPLETION EQUIPMENT & SERVICE CATALOG,* OEC5113A, available from Otis Engineering Corporation, Dallas, Texas, for a disclosure of conventional pumpdown methods and equipment.

The provision of a second tubing in the well is expensive and it would be advantageous to have a pumpdown method and apparatus which does not require the second conduit in the well.

An object of this invention is to provide a method and apparatus for TFL operations in a well in which a return flow line in the well is not required.

Another object is to provide a method and an entry loop and TFL train which can "work around the loop" and with reach rods perform operations in a well.

In working around the loop the "cathead effect" of a cable tightening on a drum when in tension will be experienced. This cathead effect will tend to move the pistons of the train off center and reduce their effectiveness.

Another object of this invention is to minimize the cathead effect when working around the loop.

The maximum forces encountered with pumpdown trains are encountered at the instance of shifting tools or of landing and retrieving tools in which pins are sheared, collars are shifted, etc., to latch or release a tool from its landing nipple.

An object of this invention is to provide a method and apparatus for performing operations in a well in which the pistons of the train are in non-curved sections of the loop when tools are being latched or released or other operations carried out so that the pistons will operate at maximum efficiency at this time.

Another object is to minimize the cathead effect on a TFL train when working around the loop.

Another object is to provide a TFL train in which the pistons will remain substantially centered when moving through the entry loop portion of the flow line.

Another object is to provide a method and apparatus for TFL operations utilizing a single tubing or flow line in the well.

Another object is to provide a method and apparatus for TFL operations in which the pistons of the TFL train do not enter the well tubing but work around the loop and spacer bars extend downwardly into the well and are connected to a tool.

Another object of the invention is to provide a method and apparatus for running and retrieving subsurface well equipment through an entry loop in which substantial force may be exerted by the pistons while positioned in the loop.

Other objects, features and advantages of the invention will be apparent from the specification, the drawings and the claims.

In the drawings wherein an illustrative embodiment of this invention is shown and wherein like numerals indicate like parts:

Figure 1:
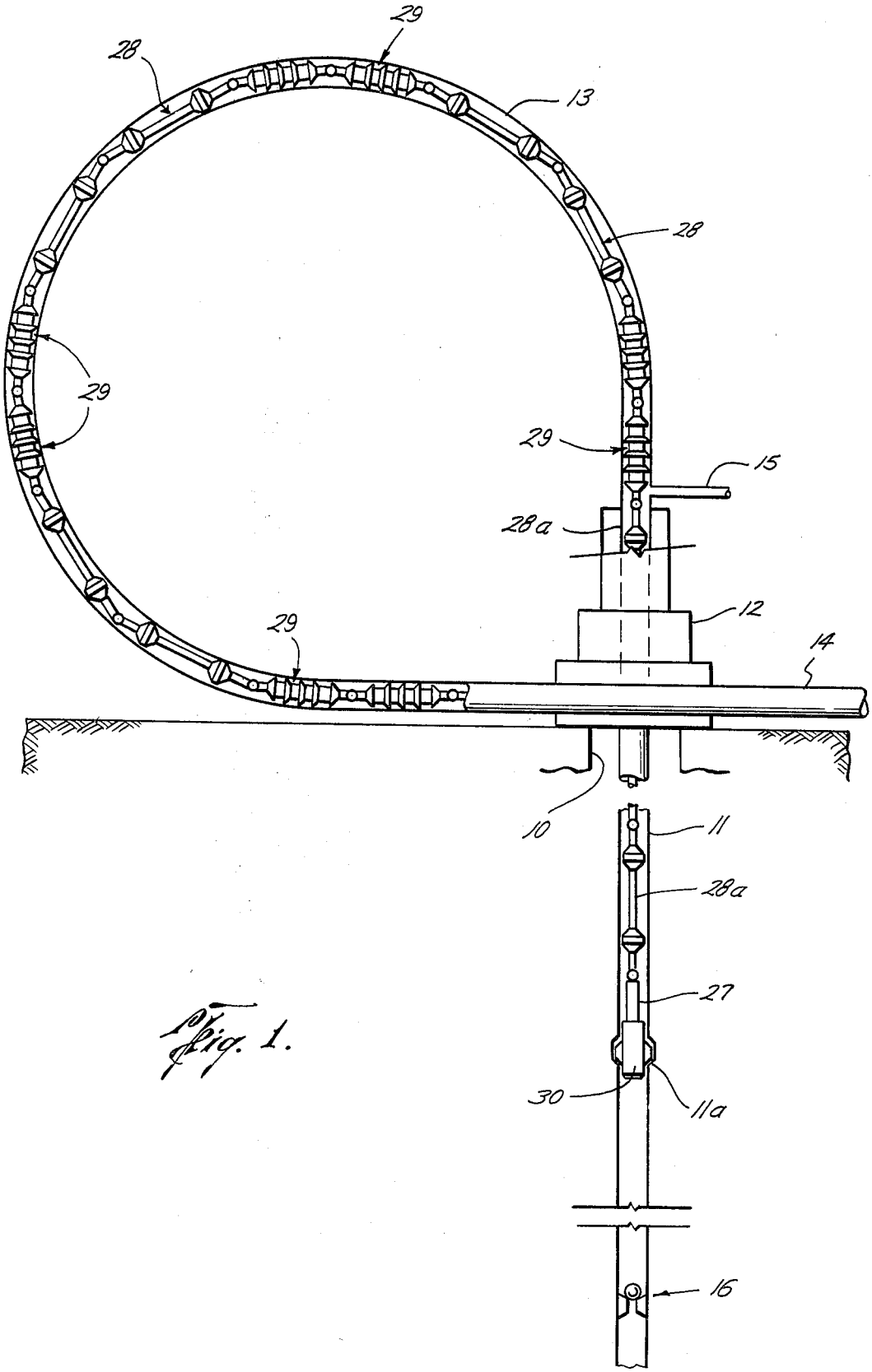
FIG. 1 is a schematic illustration of a well completed to utilize this invention and showing the TFL train working around the loop with the tool carrier supported by reach rods extending into the tubing.

In practicing the method of this invention an entry loop, such as found in pumpdown completions with subsurface wells, is provided with a conduit for introducing fluid into the loop immediately adjacent the wellhead. The connection could be in the wellhead itself, if desired, but is preferred to provide for the connection in the loop immediately adjacent the wellhead. It is preferred that the loop be constructed to have one or more straight sections joined by curved sections.

The TFL train is made up with a plurality of reach rods extending from the piston section to a conventional equipment setting or retrieving tool or other equipment.

The locomotive train will be made up of a plurality of pistons, preferably of the resilient flange type, with spacer bars preferably interconnecting piston systems which normally are made up of two pistons with their flanges preferably facing in opposite directions. The spacer bars have enlargements on each end and the enlargements adjacent to the pistons position the pistons substantially centered in the pipe making up the loop.

Preferably, the loop has straight sections, as noted above, and the train is made up with spacer bars between adjacent piston systems and between the train and a tool such that with the tool positioned in the hole at an elevation at which a tool is to be landed or retrieved or other operations carried out the several piston systems reside within straight sections of the loop. Thus, in an installation where substantial force is to be exerted by the train to land or retrieve a tool the piston systems will be in the straight sections of the loop and will be substantially centered in these sections and the pistons will be capable of exerting substantially their full power to land or retrieve the tool. During transport of the tool to and from the landed position, much less work need be done by the train and the train may readily move the tool into and out of the hole as the piston systems pass through the curved section of the loop. The straight sections of the loop may be dispensed with and a continuously curved loop employed. It is, however, preferred to use several straight sections with the pistons residing within the straight sections during landing and retrieving of a tool as the pistons may then exert their maximum force.

So that a number of piston systems may be utilized, the pistons should preferably be of the type which will bypass fluid after the pistons are loaded to a selected level. This will permit a number of piston systems to be utilized as illustrated. A suitable piston for bypassing fluid is disclosed in U.S. Pat. No. 4,078,810 which is incorporated herein by reference. By arranging a number of piston groups about the loop, the load on the train is distributed about the loop and the cat head effect is minimized.

Adjacent pistons of a pair may be arranged in the unconventional manner, that is, with their lips pointed away frome each other so that the straight sections of the loop may be approximately the same length as a pair of pistons and the functioning piston be positioned at the upstream end of a section of straight pipe, thus providing several inches of straight pipe in which the piston may move while landing or releasing a tool. This arrangement reduces the extent to which the space out problems are critical, if it is desired to make certain that the functioning piston is within a straight section of the pipe when a tool is being landed or released.

While fluid could pass through the tubing into the formation during circulation of the locomotive, it is conventional to provide a standing valve at the bottom of the tubing and the tubing will be full of fluid. Thus, while the train is being pumped in, the fluid conduit adjacent the wellhead is utilized to return fluid to the source as the train moves into the well.

When it is desired to retrieve the train, fluid is supplied through this wellhead conduit connection to act on the train in the reverse direction and pull the reach rods from the hole and pump the entire train through the production tubing to the surface.

Referring first to FIG. 1, a well having a casing 10 is completed for TFL operations with a tubing 11 which at its upper end terminates in the wellhead 12.

An entry loop of continuously curved pipe 13 is connected to the top of the wellhead in the conventional manner. The other end of the entry loop 13 connects to the flow line 14 of which the entry loop is a part. The flow line extends to the surface in the conventional manner.

A means is provided to introduce return fluid into the loop so that the train may work about the loop. This connection could be in the wellhead or directly to the loop itself, as shown at 15. The conduit 15 also extends to the surface and provides a means for returning fluid to the surface when a train is being pumped into the well. If the tubing is open at the bottom fluid could be pumped into the formation. This is undesirable, however, and normally the bottom of the tubing is provided with a standing valve, such as indicated generally at 16, which would prevent fluids from passing into the formation. Thus, with a conventional well when pumping a train into the well, fluid in front of the train would return to the surface through the conduit 15.

Figure 2:
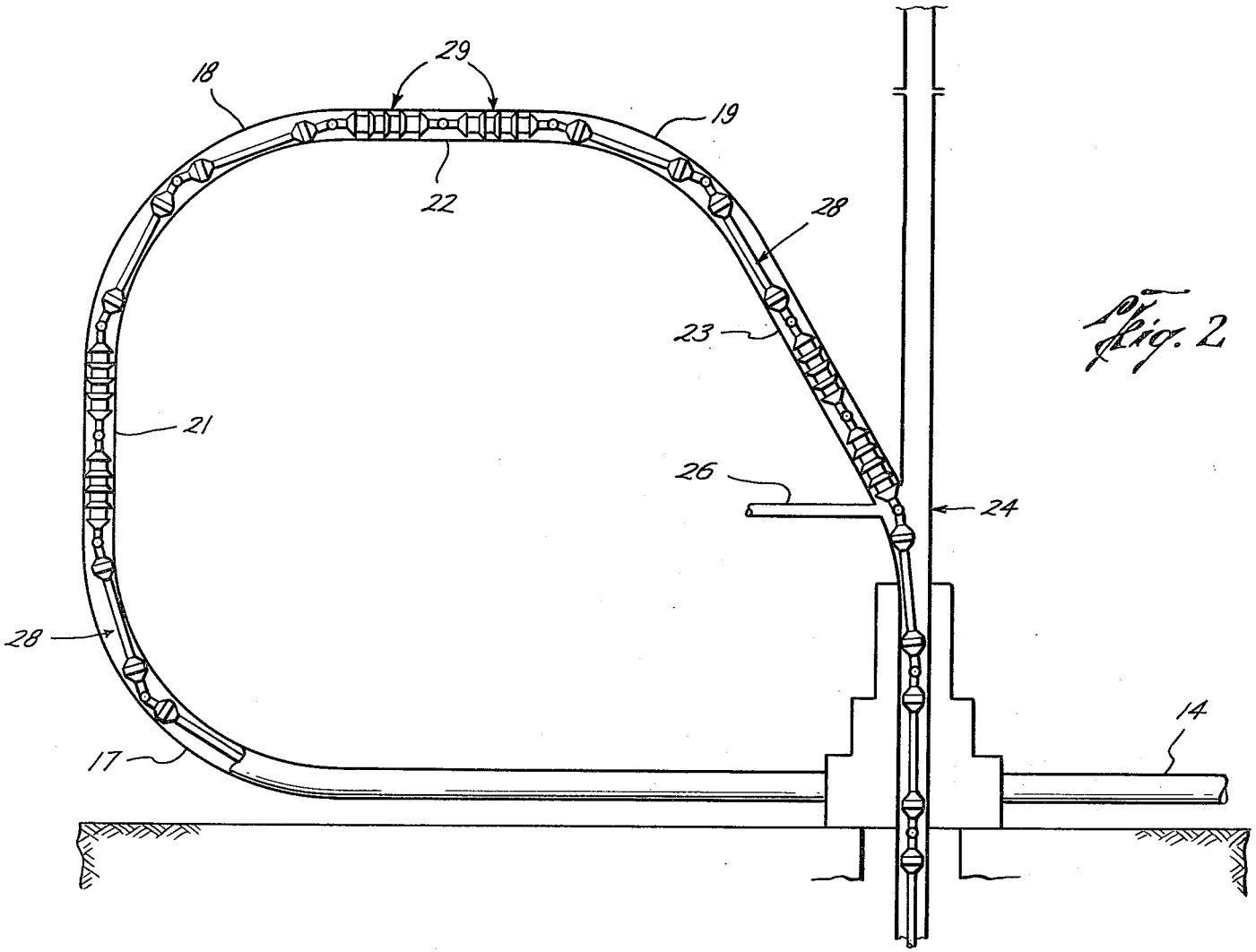
FIG. 2 is a view similar to FIG. 1 illustrating the preferred form of this invention in which the loop is provided with straight sections.
Figure 3:
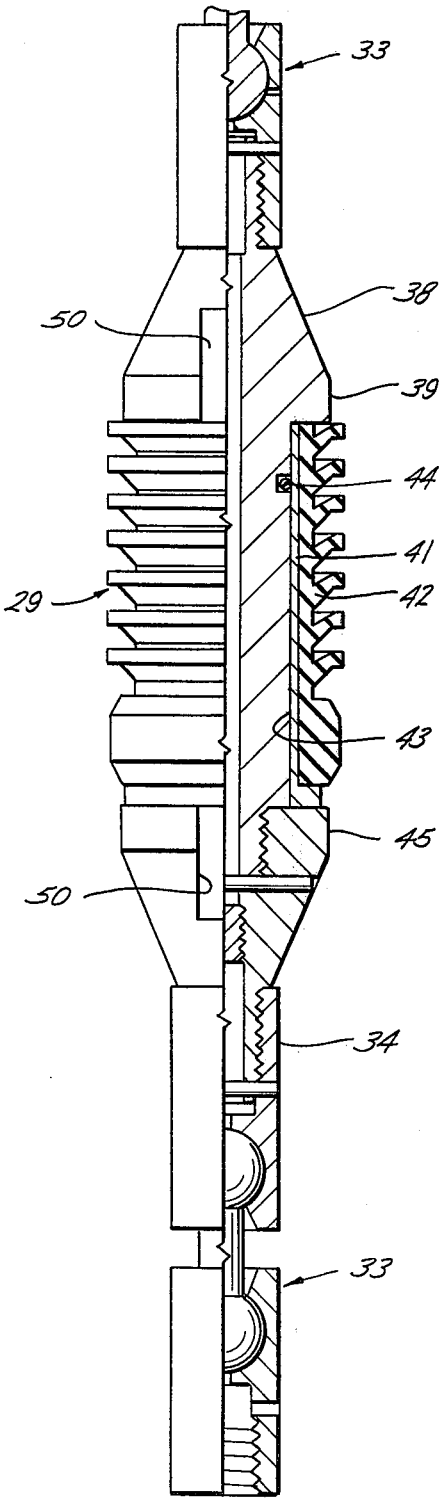
FIG. 3 is a view partly in elevation and partly in quarter-section illustrating a preferred form of piston.

The preferred form of loop is shown in FIG. 2. The flow line 14 is connected to a loop which is made up of alternate curved and straight sections. Thus, curved sections 17, 18 and 19 are interconnected by straight sections 21 and 22. Another straight section 23 interconnects the curved section 19 to the wellhead which has a conventional Y-connection, indicated generally at 24, to provide for the riser pipe. An auxiliary conduit 26 is provided for introducing reversing fluid into the loop. Neither the Y-connection nor the particular configuration of the loop illustrated in FIG. 2 are necessary to the preferred form. The preferred form may take any shape of loop in which a plurality of straight sections of pipe are provided. Loops have been used in the past having one or more straight sections but they did not include a provision for introducing reversing fluid. Such loops were not used for working about the loop as taught herein.

If, as a result of bending, the curved sections of the loop are not true, it is preferred to make the curved sections slightly larger than the straight sections so that the train may pass therethrough without hanging up on an untrue section of pipe. Preferably, the curved sections of pipe are carefully bent in a manner to insure that the curved sections of pipe are true so that they may be the same diameter as the straight sections of pipe. For instance, the curved sections can be successively heated and bent a short section at a time to produce a curved pipe without substantially distorting the pipe during bending. This method of bending pipe would be particularly useful in utilizing a continuous loop, as shown in FIG. 1, as the pistons of the train must operate in the curved section of the loop when under the greatest load.

The TFL train will be made up of a tool carrier 27 or other tool to perform operations in a well suspended from a plurality of spacer bars indicated generally at **28*a* which will extend down into the well with the pistons of the train located in the loop and position the tool carrier to either land or retrieve a tool from a landing nipple in the well or carry out other operations. Such a landing nipple is illustrated schematically at 11*a* and the tool carrier 27 is shown attached to the tool 30 landed in the nipple 11*a***.

Attached to the spacer bar **28*a* which function as reach rods are a plurality of pistons indicated generally at 29. These pistons may be sufficient in number to occupy the entire entry loop, they may be interconnected by single spacer bars or they may be interconnected by plural spacer bars, such as suggested in FIG. 2. As illustrated in FIG. 1**, alternate cups of each piston are preferably turned in opposite directions so that pressure fluid moving the train in each direction will be exerted at spaced points about the entire loop.

In the preferred form of invention, illustrated in FIG. 2, a pair of pistons 29 make up a group. Additional pistons could be provided in the group, if desired. The groups of pistons are positioned within the straight sections of the loop when the tool carrier is positioned to either land or retrieve a tool. It will be noted that the pressure responsive surfaces of the two pistons 29 and 29 of a group fall away from each other. This is contrary to the usual arrangement. The pistons may be arranged in the conventional manner in which the pressure responsive surfaces face in confronting directions, if desired, or they may be arranged as illustrated. With the illustrated arrangement, the working piston of each group has a substantial length of straight pipe in which to operate in the early stages of releasing a tool or in the final stages of latching a tool. Thus, several inches of straight pipe are available through which the working piston may move at the time when the greatest force is needed to latch or release a tool. By arranging the pistons of the several groups in this manner, the space out problem in the group of spacer bars which extend from the tool carrier up to the first group of pistons is minimized.

In the preferred form of invention the several piston groups are connected together by spacer bars. These bars are rigid and are limited in length based upon the radius of curvature of the curved sections of the loop. Thus, several spacer bars may be utilized to interconnect two groups of pistons, as illustrated in FIG. 2.

Figure 4:
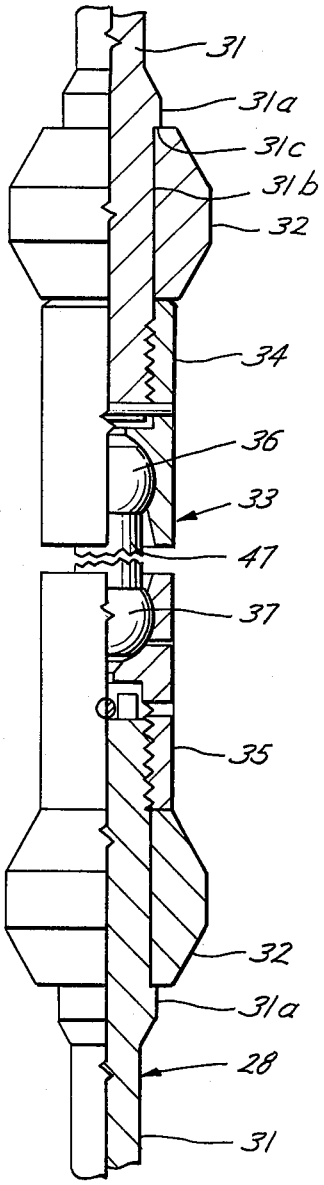
FIG. 4 is a view partly in elevation and partly in quarter-section illustrating adjacent ends of spacer bars pivotally connected together.

The spacer bars 28 are made up of bars 31, guides 32, and a knuckle joint indicated generally at 33 interconnecting the bars. The details of the spacer bars are best shown in FIG. 4. The bars 31 have an enlargement 31*a* at each end. The enlargement is reduced slightly in diameter at 31*b* to provide a shoulder 31*c*.

In order to generally centralize the knuckle joint in the pipe, guides 32 are carried on the section 31*b* of each end of the bar and are positioned between the abutment shoulder 31*c* and the nuts 34 and 35 of the knuckle joint to position the guides on the rods at a selected distance from the balls 36 and 37 of the knuckle joint 33. The length of the spacer bars 28 and the positioning of the guides are related so that the spacer bars will traverse the conventional pumpdown loop having a minimum radius of five feet. The relationship is also such that when the nut 34 or 35 of a knuckle joint is secured to a piston unit the rod 47 carrying the balls 36 and 37, will be positioned approximately in the center line of the pipe so that the force exerted on the piston 29 is substantially along the axis of the pipe and side loading on the piston is minimized.

Due to the length of the spacer bars it is preferable to use a double ball knuckle joint as shown to provide for the desired articulation between adjacent spacer bars and between a spacer bar and a piston group. It is also preferred to use a double joint between pistons in a group to permit pistons to articulate relative to each other in the curved sections of the loop. By knuckle joint as used herein is meant a joint which can articulate in any direction.

The piston 29 preferably is of the bypass regulating type so that the load on the train is distributed between the several pistons which make up the train. It is further preferred that rubber cup type pistons be utilized. These pistons may be the piston taught in U.S. Pat. No. 4,078,810 which will bypass fluid in a regulated manner and all of the pistons of a train will be loaded with fluid, as taught in said patent.

The piston may include the mandrel 38 having an enlarged guide 39 at one end thereof. The piston rubber made up of the sleeve 41 and the rubber member 42 are positioned over the central cylindrical section 43 of the mandrel. An O-ring 44 seals between the sleeve 41 and the mandrel. As the rubber 42 is molded on the sleeve 41 these parts are sealed to each other. A guide nut 45 is threaded onto the end of the mandrel and positions the swab rubber between the guide 39 and the guide nut 45.

While guides for the piston might be provided in any desired manner and in any desired number, it is preferred that each piston includes two guides with the rubber member therebetween to protect the rubber member against side loads due to the cathead effect. Preferably, the guides are only slightly smaller than the rubber member 42. For instance, their difference in diameter might be on the order of three-tenths of an inch. The relationship of the guides to the pipe is also very close and the diameter of the guide might be on the order of a few tenths of an inch less than the pipe I.D. The diameter of the rubber member is preferably on the order of a few thousandths of an inch less than the pipe I.D. Preferably, the diameter of the guides relative to the pipe is as large as practical while permitting the piston to traverse the loop. With large guides it will be appreciated that the cathead effect cannot impose substantial side loads on the rubber member of the swab and the several flanges of the rubber member will be able to bend out and engage the curved portion of the loop and function as pistons therein in the conventional manner. Flow grooves 50 are provided to readily pass fluids by the guides. .

Preferably, the pistons are arranged in groups of two and each group is connected between adjacent spacer bars 28 by a double swivel 33.

The several pistons of a group may be arranged in the conventional manner in which they have flanges which face toward each other. This is thought to give slightly more power to a pair of pistons. Where a group of pistons are utilized in straight pipe, however, it will probably be found advantageous to arrange the pistons with their flanges pointing away from each other so that at the time a tool is being landed or being released from a landing nipple or other operations are being carried out, the piston of a group which is acting as the power piston has a substantial section of the straight pipe to move in without requiring that the straight section of the pipe be substantially greater than the length of a group of pistons.

Figure 5:
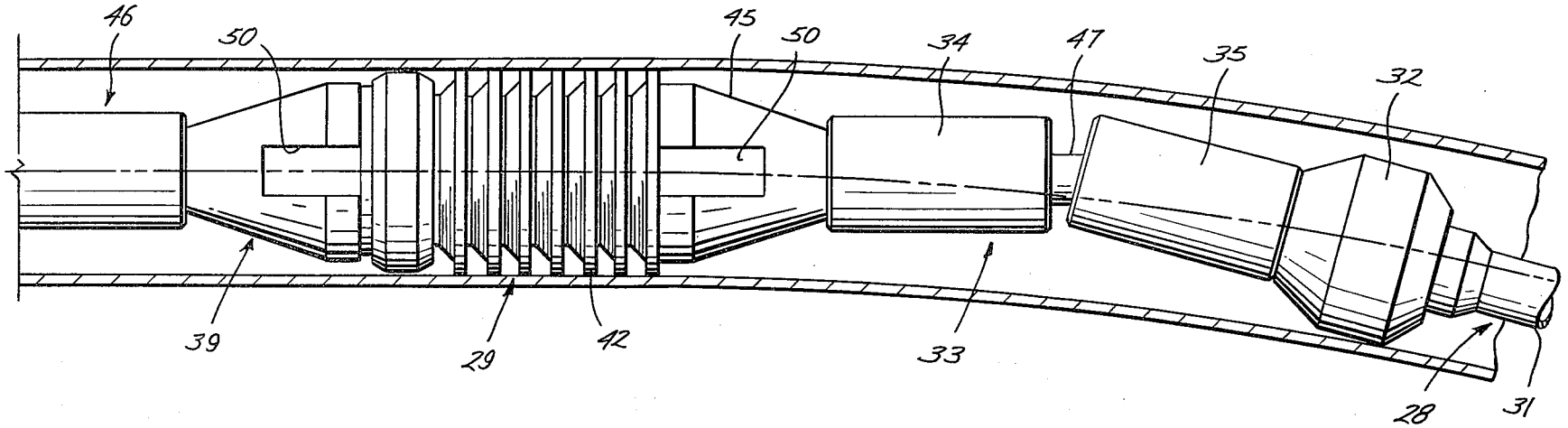
FIG. 5 is a fragmentary view of a portion of an entry loop and a portion of a TFL train illustrating the manner in which the pivotal connection between a spacer bar and piston pivots about the central axis of the pipe.

The relationship of the several components of the piston and spacer bar, and particularly when utilized with a loop having straight sections, is best illustrated in FIG. 5 which shows the preferred form of the invention. The relationship of the length of the spacer bar, the diameter of the guides, and the spacing of the guides from the double ball 36-37 of the knuckle joint is shown to be such that the tensional force exerted on the piston is exerted along the center line of the pipe. In FIG. 5 the spacer bar 28 is shown to be positioned within a curved section of the loop and one piston 29 of a group is shown to be positioned in a straight section of the loop. With the train in tension, the rod 47 interconnecting the two balls 36-37 is approximately coaxial with the piston 29 and a force is thus applied to the piston which is coaxial with the straight section of the pipe. This minimizes placing of side loads on the piston 29 while they are in the straight section of the pipe and subjected to the greatest resistance due to performing operations such as landing or retrieving a tool in the well. This relationship is also preferably followed when the entry loop does not have any straight sections, but is a continuous curve, as the application of force when the system is in tension is also approximately at the center line of the pipe, thus minimizing the cathead effect on the pistons.

In operation the wellhead is provided with the desired form of entry loop and provision is made for reverse flow of fluid to the loop at the wellhead or thereabove. The desired form of pumpdown train is made up and a sufficient length of spacer bars provided at the end of the piston section of the train to provide reach rods to reach down into the well to the area at which a tool is to be landed or retrieved. A tool holder 27 is connected to the reach rod section of the train and a tool, such as tool 30, may be made up on the train to be run into the hole or the train may be utilized to retrieve a tool, such as tool 30, already in the well.

The train is pumped into the well until the tool carrier 27 is located adjacent the landing nipple. At this time in the preferred form the piston groups will reside within the straight sections of the loop. Continued application of pressure will either land the tool or will cause the tool carrier to latch on to the tool.

After the tool carrier is latched to the tool or the tool is landed, flow in the system is reversed and pressure fluid is introduced through the conduits 15 or 26, depending upon the use of the loop of FIG. 1 or FIG. 2 and reverse flow conditions are established to withdraw the train from the well. At this time the pistons will be in the straight sections of the loop if the FIG. 2 form of invention is used as this is the time when maximum force is needed to land or to release a tool from the landing nipple. In either event the application of reverse fluid flow will return the train to the surface.

When the train is placed in compression, the guides of the spacer bars will tend to ride on the outside of the loop. The knuckle joints will permit the pistons to remain substantially centered and the guide means on the pistons will prevent the compressive forces from forcing the pistons off center to any substantial degree. In the event the spacer bars do not maintain the pistons centered in the straight sections of the loop, the piston guides limit the cathead effect in the FIG. 2 system. In the FIG. 1 system these piston guides limit the cathead effect on the pistons.

The foregoing disclosure and description of the invention is illustrative and explanatory thereof and various changes in the method, in the process, in the size, shape and materials, as well as in the details of the illustrated construction, may be made within the scope of the appended claims without departing from the spirit of the invention.

What is claimed is:

1. The method of performing operations in a well having an entry loop of pipe at the wellhead comprising;

establishing reverse fluid communication with the loop on the wellhead side of the loop;

making up a TFL train with a tool, spacer bars and pistons with said spacer bars having a length between the pistons and tool which will position pistons in the loop and on the loop side of the point of reversing fluid communication with the tool positioned to do work in the well;

running said TFL train into the loop and well;

loading all of said pistons with pressure fluid so that all pistons will exert a force on the TFL train; and performing the desired operation while said pistons are in said loop.

2. The method of performing operations in a well having an entry loop of pipe at the wellhead comprising;

establishing reverse fluid communication with the loop on the wellhead side of the loop;

making up a TFL train including a tool, spacer bars and pistons, with the bars and pistons having means for maintaining the pistons substantially centered in the pipe;

said train being made up with spacer bars having a length between the pistons and tool which will position pistons in the loop and on the loop side of the point of reversing fluid communication with the tool positioned to do work in the well;

running said TFL train into the loop and well;

loading all of said pistons with pressure fluid so that all pistons will exert a force on the TFL train; and performing the desired operation while said pistons are in said loop.

3. The method of performing TFL operations comprising;

attaching to a wellhead an entry loop having a plurality of straight sections;

establishing reversing fluid communication with the loop on the wellhead side of the loop;

making up a TFL train with a tool, spacer bars and piston groups wherein one group of said spacer bars have a length between the pistons and tool which will position pistons in the loop when the tool is in a position to perform operations; and wherein spacer bars positioned between piston groups are dimensioned to position said piston groups in the straight sections of said loop when the tool is at said point in the well where operations are to be performed;

running said TFL train into the loop and well;

loading all of said pistons with pressure fluid so that all pistons will exert a force on the TFL train; and performing operations in the well while said pistons are in said straight sections of the loop.

4. The method of performing TFL operations comprising;

attaching to a wellhead an entry loop having a plurality of straight sections;

establishing reversing fluid communication with the loop on the wellhead side of the loop;

making up a TFL train with a tool carrier, spacer bars and piston groups wherein at least one of said spacer bars and piston groups has means for maintaining the pistons substantially centered in the entry loop pipe, wherein one group of said spacer bars has a length between the pistons and tool approximately equal to the distance between the point of reversing fluid communication and the point in the well at which operations are to be performed, wherein said pistons are connected to said group of spacer bars and positioned in the entry loop when the tool carrier is at said point in the well where operations are to be performed, and wherein spacer bars positioned between piston groups are dimensioned to position said piston groups in the straight sections of said loop when the tool is at said point in the well where operations are to be performed;

running said TFL train into the loop and well;

loading all of said pistons with pressure fluid so that all pistons will exert a force on the TFL train; and performing said operations in the well while said pistons are in said straight sections of the loop.

5. In combination:

an entry loop for TFL tools, comprising several arcuate sections of pipe interconnected by straight sections of pipe;

an auxiliary fluid line communicating with the loop adjacent the end to be connected to a wellhead; and a TFL train of tool, pistons and spacer bar means interconnected by knuckle joints and dimensioned to arrange at least a pair of pistons with opposed pressure responsive surfaces in each straight section when the tool is positioned in the well at a depth to perform operations in the well.

6. The combination of claim 5 wherein said pistons have centralizers of substantially the same diameter as the diameter of the pressure responsive elements of the piston.

7. The combination of claims 5 or 6 wherein the spacer bar means have centralizing guides spaced from each end thereof a distance correlated to the radius of said loop to position the knuckle joint at each end of a spacer bar means attached to a piston at the central axis of the loop to minimize the cathead effect on said pistons.

8. The combination of claims 5, or 6 wherein said pair of pistons have their pressure responsive surfaces facing away from each other.

9. The combination of claim 7 wherein said pair of pistons have their pressure responsive surfaces facing away from each other.

10. A TFL train comprising:

a tool carrier;

a string of spacer bars connected to said tool carrier;

a plurality of piston means connected to said string of spacer bars; and spacer bar means between each set of pistons;

all of said spacer bars, spacer bar means, tool carrier and pistons being interconnected by knuckle joints;

said spacer bar means having rigid centralizing guides spaced from each end thereof a distance correlated with the radius of a loop with which they are to be used to position the pivot point at each end of a spacer bar means connected to a piston at the central axis of the loop to minimize the cathead effect on the pistons.

11. The TFL train of claim 9 wherein each piston is provided with centralizer means.

12. The TFL train of claim 9 wherein each piston is provided with centralizer means at each end having substantially the same diameter as the diameter of the pressure responsive elements of the piston.

13. An entry loop for TFL tools comprising:

several arcuate sections of pipe interconnected by straight sections of pipe; and an auxiliary fluid connection adjacent the end of the loop to be connected to a wellhead.

* * * * *